US011460031B2

(12) United States Patent
Blad et al.

(10) Patent No.: US 11,460,031 B2
(45) Date of Patent: Oct. 4, 2022

(54) CENTRIFUGAL PUMP ASSEMBLY

(71) Applicant: GRUNDFOS HOLDING A/S, Bjerringbro (DK)

(72) Inventors: Thomas Blad, Bjerringbro (DK); Christian Blad, Bjerringbro (DK); Peter Mønster, Randers (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 61 days.

(21) Appl. No.: 16/980,057

(22) PCT Filed: Mar. 12, 2019

(86) PCT No.: PCT/EP2019/056079
§ 371 (c)(1),
(2) Date: Sep. 11, 2020

(87) PCT Pub. No.: WO2019/175133
PCT Pub. Date: Sep. 19, 2019

(65) Prior Publication Data

US 2021/0003133 A1 Jan. 7, 2021

(30) Foreign Application Priority Data

Mar. 13, 2018 (EP) ..... 18161524

(51) Int. Cl.
*F04D 15/00* (2006.01)
*F04D 13/06* (2006.01)
*F04D 29/48* (2006.01)

(52) U.S. Cl.
CPC ..... *F04D 15/0016* (2013.01); *F04D 13/0606* (2013.01); *F04D 29/486* (2013.01)

(58) Field of Classification Search
CPC . F04D 29/486; F04D 1/00; F04D 1/14; F04D 13/0606; F04D 15/005;
(Continued)

(56) References Cited

U.S. PATENT DOCUMENTS 4,679,983 A * 7/1987 Pietryk ..... B60S 1/481 137/625.46
4,869,076 A 9/1989 Sakai et al.
(Continued)

FOREIGN PATENT DOCUMENTS

JP H1043121 A 2/1998

*Primary Examiner* — Richard A Edgar
*Assistant Examiner* — Jason G Davis
(74) *Attorney, Agent, or Firm* — McGlew and Tuttle, P.C.

(57) ABSTRACT

A centrifugal pump assembly includes an electrical drive motor (2), with at least one impeller (18) which is driven by the motor and a pump casing (6) which surrounds the impeller (18) and which includes at least one suction connection (20) and at least two delivery connections (22, 24). A rotatable valve element (30, 30', 30") is arranged in the pump casing (6). The valve element is movable between at least two switching positions, in which the flow paths through the delivery connections (22, 24) are opened to a different extent. The valve element (30, 30', 30") includes an annular wall (32) which surrounds the impeller (18) and in which at least one switching opening (48) is formed. The valve element (30, 30', 30") is rotatably mounted about a rotation axis (X), which is centric to the annular wall (32), inside of the pump casing (6).

24 Claims, 12 Drawing Sheets

(58) Field of Classification Search
CPC ..... F04D 15/0016; F04D 17/08; F04D 17/10; F04D 29/4273; F04D 29/4286; F04D 29/4293; F04D 29/447; F04D 29/466; F04D 29/468; F16K 11/0853; A47L 15/4221; A47L 15/4225
See application file for complete search history.

(56) References Cited

U.S. PATENT DOCUMENTS

| | | | | |
|---|---|---|---|---|
| 7,100,623 | B2 * | 9/2006 | Assmann ..... | F16K 11/0853 134/184 |
| 2004/0071547 | A1 | 4/2004 | Elexpuru | |
| 2004/0173249 | A1 | 9/2004 | Assmann et al. | |
| 2017/0356449 | A1 | 12/2017 | Blad et al. | |

* cited by examiner

CENTRIFUGAL PUMP ASSEMBLY

CROSS REFERENCE TO RELATED APPLICATIONS

This application is a United States National Phase Application of International Application PCT/EP2019/056079, filed Mar. 12, 2019, and claims the benefit of priority under 35 U.S.C. § 119 of European Application 18 161 524.6, filed Mar. 13, 2018, the entire contents of which are incorporated herein by reference.

TECHNICAL FIELD

The invention relates to a centrifugal pump assembly with a valve element which is arranged in a pump casing of the centrifugal pump assembly.

TECHNICAL BACKGROUND

Centrifugal pump assemblies usually comprise at least one impeller which is driven by an electrical drive motor. The impeller rotates in a pump casing, so that it can deliver fluid out of the suction connection to at least one delivery connection. Moreover, centrifugal pump assemblies, concerning which a valve element is integrated into the pump casing are also known. The flow can be selectively led to one of two delivery connections via such a valve element, depending on the switching position, in which the valve element is located.

SUMMARY

It is an object of the invention to improve the valve device in such a centrifugal pump assembly with regard to the function and construction.

The centrifugal pump assembly according to the invention comprises an electrical drive motor which rotatingly drives at least one impeller of the centrifugal pump assembly. The electric drive motor can preferably be a canned motor or a wet-running electrical drive motor. The impeller is arranged in a pump casing which surrounds the impeller. The pump casing comprises a suction connection which is connected to a suction port of the impeller. Furthermore, the pump casing comprises at least two delivery connections. The two delivery connections can serve for example for guiding the flow which is produced by the impeller, selectively into two different circuits of a heating facility, for example into a heating circuit or heat exchanger for service water heating. A rotatable valve element which is movable between at least two switching positions, in which the flow paths through the at least two delivery connections are opened to a different extent, is arranged in the pump casing. Particularly preferably, in a first switching position, a flow path through a first delivery connection is open, whilst a flow path through the second delivery connection is closed. Accordingly, preferably in the second switching position, the flow path through the first delivery connection is closed and the flow path through the second delivery connection is opened. The valve element can therefore serve as a switch-over valve.

The valve element, according to the invention comprises an annular wall which surrounds the impeller and in which at least one switching opening is formed. This switching opening can be brought into different positions or switching positions by way of rotating the valve element, in order to open the flow paths to a different extent in the manner described above. The valve element is rotatably mounted about a rotation axis which is concentric to the annular wall, in the inside of the pump casing. The annular wall in the peripheral region of the impeller has the advantage that it can simultaneously serve for guiding the flow. Furthermore, a flow which is generated by the impeller can engage on the annular wall in a direct manner, in order to rotate the valve element about the rotation axis in dependence on the flow. The flow which is produced by the impeller can therefore be used to move the valve element from one switching position into the other switching position.

According to a preferred embodiment of the invention, at least one, preferably two outlet openings which are connected to the delivery connections and with which the at least one switching opening can be brought to at least partly overlap depending on the switching position of the valve element are situated in a wall of the pump casing which faces the annular wall. Particularly preferably, a switching opening can be selectively brought to overlap with one of two outlet openings, in order to realize a switch-over function between the two outlet openings by way of rotation of the valve element. Alternatively or additionally to a switch-over function, a flow change can also be achieved by way of the switching opening being brought to overlap with at least one outlet opening to a different extent.

According to a further preferred embodiment of the invention, the valve element in the inside of the annular wall comprises a wall which extends transversely to the rotation axis and which preferably surrounds a suction port of the impeller. This wall therefore forms a base surface in the inside of the annular wall. In particular, the wall can create the connection of the annular wall to a mounting of the valve element. Furthermore, the wall can serve as an engagement surface for a flow which is produced by the impeller, so that the flow can rotate the valve element between the switching positions. The wall is further preferably configured as an annular surface which annularly surrounds the suction port of the impeller. Herein, the suction part preferably lies centrally in the wall. Thus further preferably, this wall can separate the suction side and the delivery side in the inside of the pump casing from one another.

Further preferably, the annular wall comprises a circular outer contour and particularly preferably a cylindrical or conical outer contour. This configuration has the advantage that the annular wall can move preferably at a constant distance parallel to an inner wall of the pump casing on rotation of the valve element.

Further preferably, the valve element is rotatably mounted on a stationary component in the inside of the pump casing. This stationary component can be configured as one piece with the pump casing or however be fastened to this casing in a rotationally fixed manner. An independent mounting for the valve element is therefore created.

According to a further preferred embodiment of the invention, the at least one switching opening at its edge is completely surrounded by at least one section of the annular wall. I.e. the switching opening is configured as a hole or as an opening in the annular wall. A sealing or contact surface can be created in the peripheral region of the switching opening by way of the fact that the switching opening is surrounded by a preferably closed edge. Furthermore, the annular wall at its free end can comprise a continuously closed edge which for sealing can be brought to bear on a wall of the pump casing. The free end of the annular wall is thereby preferably that axial end which is away from that end, at which the wall which extends transversely to the rotation axis lies.

Further preferably, the annular wall in an extension direction transversely to its periphery extends at an angle of smaller than 90° and preferably smaller than 45° to the rotation axis of the valve element. A cylindrical or preferably conical shape of the annular wall results from this. Such a shape has the advantage that for sealing, at least sections of the annular wall can be easily brought to bear on an inner wall of the pump casing.

According to a further preferred embodiment of the invention, the valve element comprises at least one movable section, which is movable between a bearing (contacting) position, in which the section bears on a contact surface in the pump casing, preferably with a friction fit, and a released position, in which the section is movable relative to the contact surface on rotation of the valve element. The at least one movable section of the valve element and the contact surface can thus function as a coupling which serves for holding the valve element in the reached switching position. The movement of the at least one movable section of the valve element is herein effected by way of the fluid pressure which is produced by the impeller. A coupling which can be engaged and released again in a pressure-dependent manner can therefore be created and this coupling can be brought into engagement and released again solely by way of the pressure build up in the pump casing, depending on the operating conditions of the drive motor. The bearing contact between the valve element and the contact surface can herein be achieved in a solely frictional manner or possibly additionally positive manner by way of engagement elements which are arranged on the valve element and/or on the contact surface. Firstly, the valve element is brought into its released position, in order to be able to rotate the valve element from one switching position into the other switching position, which is preferably effected by way of a reduction of the pressure in the pump casing or in the delivery chamber which surrounds the impeller. Such a pressure reduction can be achieved by way of a speed reduction of the drive motor or by way of switching off the drive motor.

Usefully, the valve element or the at least one movable section of the valve element is configured in a manner such that by way of the bearing contact of the movable section or valve element on the contact surface, the valve element is held in its assumed switching position. The at least one movable section of the valve element or the complete valve element, as is described below, hence function as a friction-fit coupling which in the bearing position serves for fixing the valve element in an assumed switching position or securing it against movement into the other switching position. In the released position, the valve element is released, so that it can move between the switching positions.

The at least one movable section can particularly preferably be configured as an elastic edge section of the annular wall. Further preferably, the complete annular wall can be configured in an elastic manner, so that it can preferably be deflected radially outwards by a pressure which prevails in the inside of the annular wall. Herein, restoring forces can be produced by an elastic configuration of the wall section, said restoring forces moving the movable section into its initial position again, preferably automatically, when the applied pressure ceases.

Alternatively or additionally, according to a further possible embodiment of the invention, the complete valve element is movable in a direction transversely to its rotation direction, preferably parallel to its rotation axis, between a released and a bearing position. The movement direction of the valve element between the released position and the bearing position is therefore a different movement direction than that movement direction, in which the valve element is moved between the switching positions. A movement between the switching positions can therefore be achieved independently of the fixation of the valve element. The valve element is preferably mounted on the rotation axis in an axially displaceable manner, in order to achieve a movability of the valve element in the direction of its rotation axis.

Further preferably, the valve element and the pump casing are configured such that in the bearing position, at least a section of the valve element bears on an inner wall of the pump casing. The inner wall of the pump casing therefore forms a contact surface and together with the section of the valve element forms the coupling which is described above. Such a coupling can be realized with very few components in this manner. Essentially no components additionally to the valve element and the already present pump casing are necessary.

The valve element is preferably configured and arranged in a manner such that a pressure which prevails in the peripheral region of the impeller acts upon the valve element such that the at least one movable section or the complete valve element is moved into the bearing position. Further preferably, the pressure which prevails in the peripheral region of the impeller holds the valve element in fixed bearing contact on the contact surface, in particular on an inner wall of the pump casing. The valve element is therefore held in its bearing position and thus fixed in the reached switching position by the pressure in the peripheral region of the impeller. The pressure in the peripheral region of the impeller is produced by the impeller on rotation of this. The described coupling which is formed by the at least one section of the valve element or a wall of the valve element with a contact surface can therefore be brought into engagement by the pump assembly without further actuating means. A coupling which can be engaged and disengaged again solely by way of activation of the drive motor is therefore created.

Furthermore, a force generating means, particularly preferably in the form of a spring, which subjects the valve element or its at least one movable section to force out of the bearing position in the direction of the released position is further preferably provided. By way of this, one succeeds in the valve element or its at least one movable section being automatically moved back into its initial or idle position which corresponds to the released position, when the pressure in the delivery chamber at the outlet side of the impeller falls below a predefined value. A coupling which automatically or autonomously disengages given a reduction of the pressure is therefore created. This means that the coupling can be brought into bearing position or into engagement by way of increasing the pressure in the delivery chamber. It can be released again by way of pressure reduction. For this, it is preferable for the activation of the drive motor and/or the configuration of the drive motor and the force generating means to be matched to one another such that the force of the force generating means is overcome at a certain speed of the drive motor or at a certain delivery pressure, in order to bring the valve element or its at least one movable section into the bearing position. Conversely, the force generating means is preferably dimensioned such that it reliably moves the valve element or its movable section into the released position again on falling short of a defined speed or a defined outlet pressure.

According to a particularly preferred embodiment of the invention, a flow guidance element which leads to the at least one switching opening and which is further preferably configured in a spiral manner can be situated on the inner periphery of the annular wall. A spiral channel which leads to the switching opening and therefore to the outlet and which preferably rotates preferably together with the valve element when this element is moved between its switching positions can thus be created in the peripheral region of the impeller. An optimal flow guidance towards the outlet is therefore always ensured, irrespective of the switching position, in which the valve element is located.

Particularly preferably, the valve element is configured as a molded/cast part of metal or plastic, in particular as an injection molded part of plastic. This permits an inexpensive manufacture and simultaneously provides the possibility of being able to form complex geometries such as for example a flow guidance in the valve element, in a simple manner.

According to a further possible embodiment of the invention, the valve element in its center comprises a bearing sleeve which rotatably slides on a stationary bearing bolt in the pump casing. The bearing bolt can be configured as one piece with the pump casing or be a separate component which is fixed in the pump casing. The bearing sleeve is preferably configured as one piece with the other sections of the valve element. The bearing sleeve is preferably configured such that a closed bearing space is formed between the bearing sleeve and the bearing bolt, so that a permanent lubrication or a pre-lubrication can be provided in this, by which means an ease of movement of the rotation movement of the valve element on the bearing bolt is ensured. Alternatively or additionally, a lubrication of the mounting can be provided by the delivered fluid, wherein the bearing gap between the bearing sleeve and the bearing bolt is preferably protected from penetrating contamination, in order to ensure a permanent ease of movement.

According to a further possible embodiment of the invention, the valve element can be rotatably mounted on an inlet stub (inlet nozzle or inlet branch) which is arranged in the pump casing and is engaged with a suction port of the impeller. An annular bearing surface which surrounds the suction port is created with this arrangement. This arrangement has the advantage that the inside of the suction port and of the suction stub can remain free of bearing elements, so that low flow resistances in the suction region of the impeller can be ensured. A sealing between the valve element and the suction stub can simultaneously be created, so that the valve element can separate a suction-side chamber from a delivery-side chamber in the inside of the pump casing.

Further preferably, a restoring element which acts upon the valve element in its rotation direction can be provided. Herein, the restoring element is preferably configured such that the valve element moves into a predefined initial position which preferably corresponds to one of the possible switching positions, given a standstill of the impeller. Such a restoring element can be formed for example by a spring or be a magnetically acting restoring element. Particularly preferably, the valve element is configured such that it creates a restoring movement by way of gravity, which is to say that the restoring element is configured as a weight which is preferably arranged in the valve element in an eccentric manner, so that the weight exerts a torque upon the valve element when the valve element is deflected out of its initial position. Since centrifugal pump assemblies as are applied for example in heating circulation pumps usually have an defined installation position, with regard to which the shaft of the drive motor runs horizontally, then a defined initial position, in which the weight is located in a lower of at least two possible positions can be ensured. On rotating the valve element into another switching position, the weight is lifted for as long as an adequate force is exerted upon the valve element by the flow. If this forces ceases, then the gravity moves the valve element back into its initial position.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
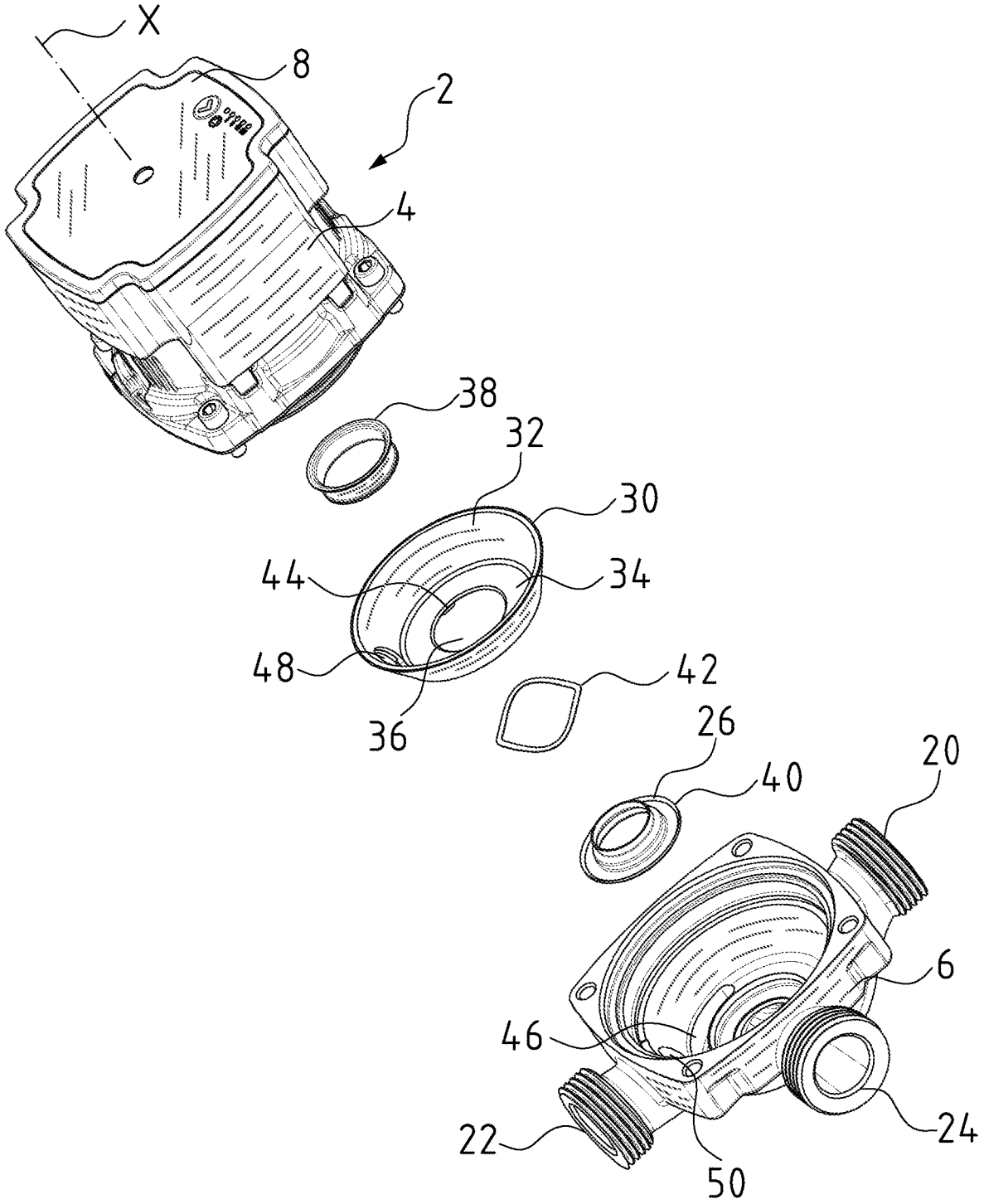
FIG. 1 is a first perspective exploded view of a centrifugal pump assembly according to a first embodiment of the invention.
Figure 2:
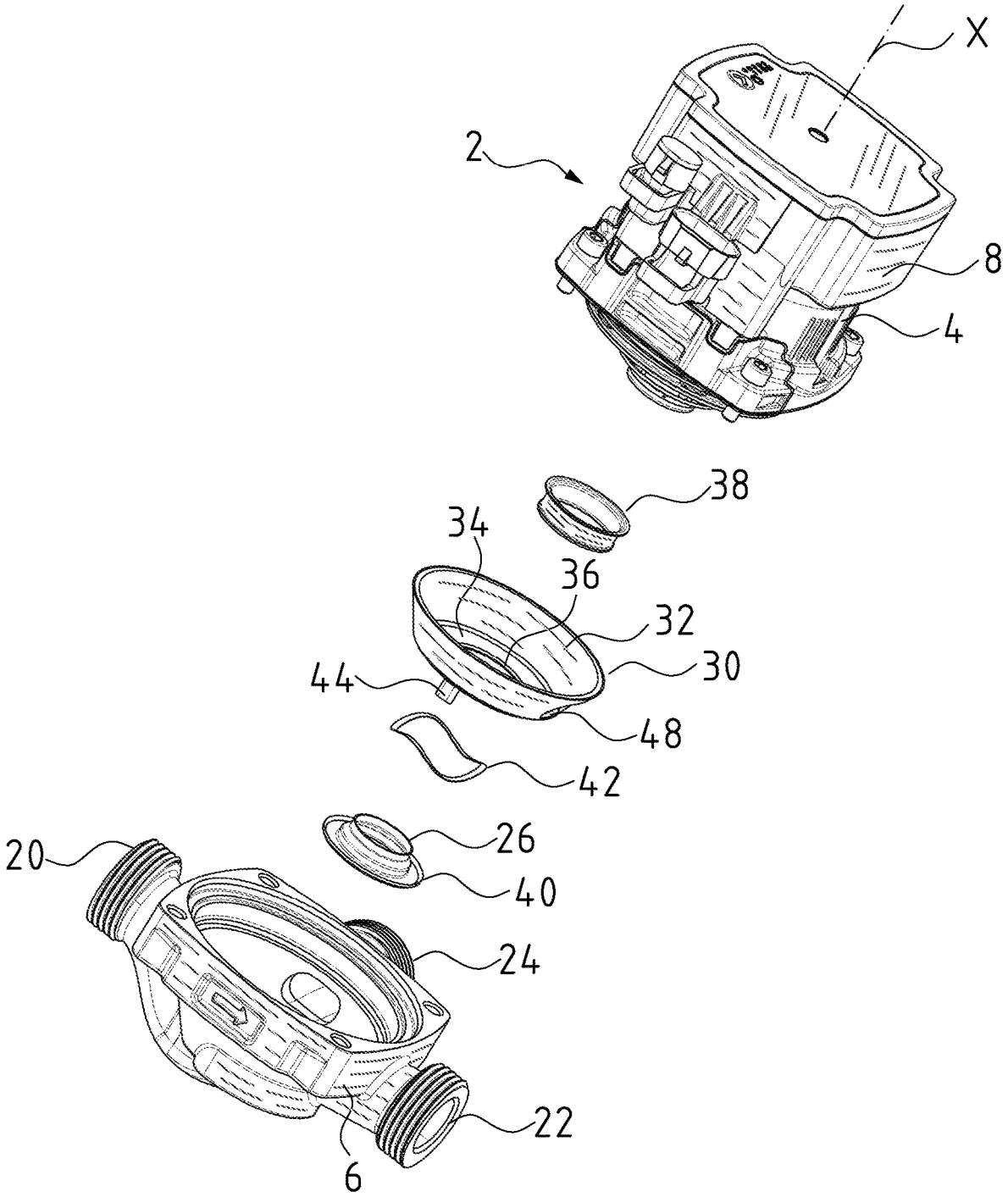
FIG. 2 is a perspective exploded view of the centrifugal pump assembly according to FIG. 1 from another perspective.

Referring to the drawings, the centrifugal pump assemblies which are described hereinafter are envisaged as heating circulation pump assemblies, in particular for use in a heating facility, such as a compact heating facility which serves for heating a building as well as for heating service water. The centrifugal pump assembly according to the first embodiment of the invention comprises an electrical drive motor 2 which is arranged in a motor casing 4. The motor casing 4 is connected to a pump casing 6. An electronics housing 8 which comprises the electrical or electronic components for the control and/or regulation of the drive motor 2 is arranged at the axial end of the motor housing 4 which is away from the pump casing 6. The electrical drive motor 2 is a wet-running electrical drive motor. This means that the stator space, in which the stator 10 is arranged, is separated from a rotor space, in which the rotor 12 is arranged, by a can pot or can 14. The rotor 12 therefore rotates in the fluid to be delivered. The rotor 12 drives an impeller 18 via a rotor shaft 16 in the known manner. The impeller is arranged in the pump casing 6.

The pump casing 6 comprises a suction connection 20 as well as two delivery connections 22 and 24. The suction connection 20 runs out at the base of the pump casing 6. A suction stub (branch) or inlet stub 26 which engages into the inside of a suction port 28 of the impeller 18 is arranged there.

A pot-like valve element 30 is arranged in the inside of the pump casing 6 in a manner surrounding the impeller 18. The valve element 30 comprises a circular outer contour and extends concentrically to the rotation axis X of the drive motor 2 and of the impeller 18. The valve element 30 comprises an annular wall 32 on the outer periphery, said annular wall having a truncated-cone-shaped or conical outer contour and having an outer contour which corresponds essentially to the inner contour of the pump casing 6 in the peripheral region of the rotation axis X. The valve element 30 is completely opened at that axial end of the annular wall 32 with the larger diameter. At the opposite axial end which is smaller in diameter, the valve element 30 comprises a wall 34 which forms a base of the valve element 30. The wall 34 extends transversely to the annular wall 30 and normally to the rotation axis X. The wall 34 herein forms an annular wall which extends radially inwards departing from the annular wall 32 and surrounds a central opening 36. The inlet stub 26 extends through the opening 36. This means that the valve element 30 is placed with the opening 36 onto the inlet stub 26 and is fixed there by way of an annular securing element 38. The annular securing element 38 engages from the inside into the opening 36 and is fixed on the inlet stub 26, for example in a clamped manner. The inlet stub 26 and the annular securing element 38 are therefore configured such that the valve element 30 is guided in the radial direction but permits a certain movement in the axial direction parallel to the longitudinal axis X.

Figure 7:
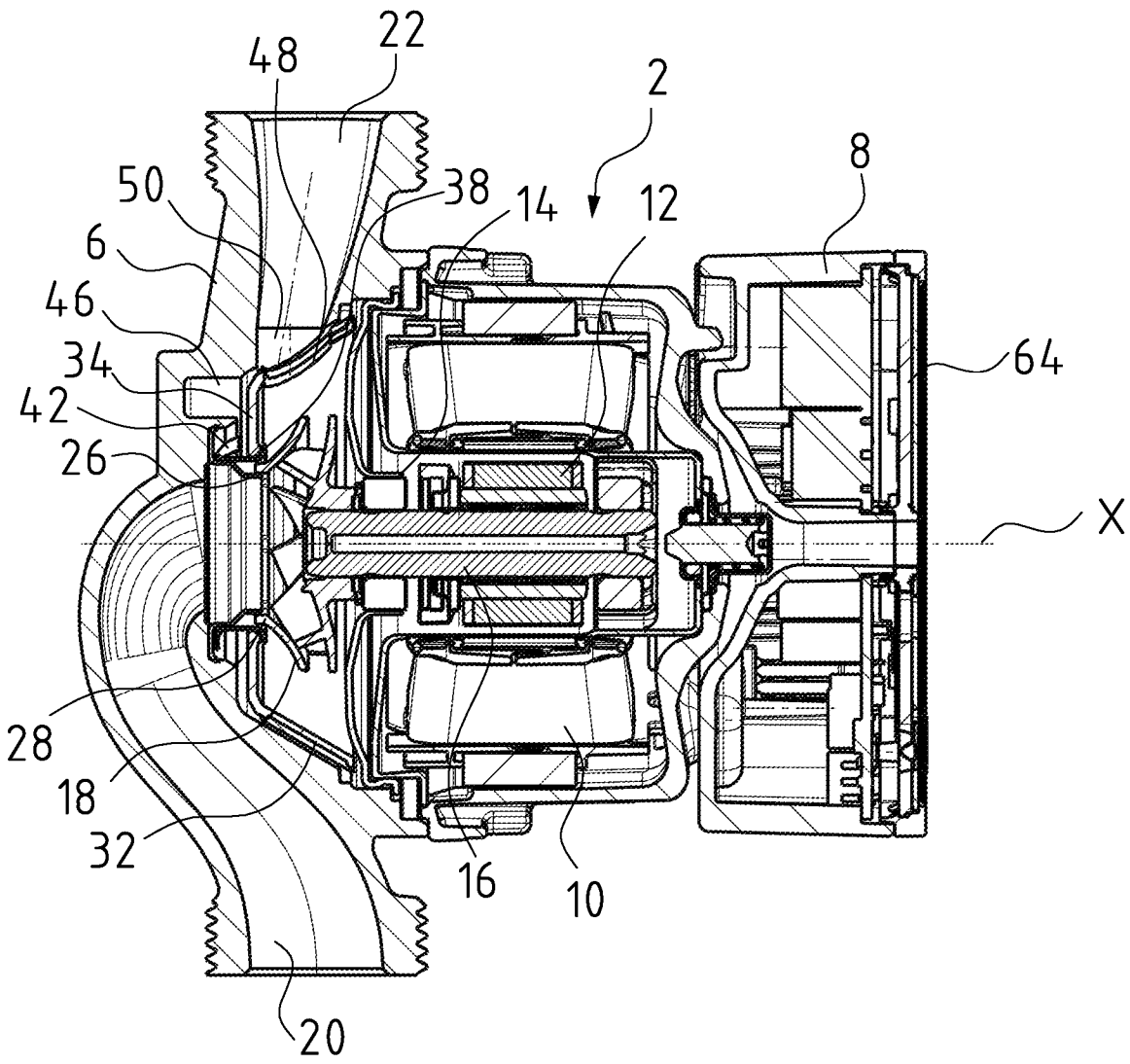
FIG. 7 is a sectioned view along the line A-A in FIG. 6 with a valve element in a released position.

Furthermore, a spring in the form of a corrugated spring ring 42 is arranged between the radially projecting shoulder 40 of the inlet stub 26 and the wall 34 of the valve element 30. The spring acts in the axial direction in the direction of the longitudinal axis X and presses the valve element 30 away from the shoulder 40 in the direction of the drive motor 2. In this position, as is shown in FIG. 7, the annular wall 32 as well as the wall 34 is distanced to the inner surface of the pump casing 6, so that the valve element 30 can essentially freely rotate about the inlet stub 26 which is to say about the longitudinal axis X, in the inside of the pump casing. In this state, a rotating flow which is generated by the impeller in the inside of the valve element 30 in the peripheral region of this impeller 18 can co-rotate the valve element 30 on account of the friction between the flow and the wall surfaces of the valve element 30 (inner surface of the annular wall 32 as well as the wall 34). The rotation movement is limited by a stop pin 44 which in the base of the pump casing 6 engages into an arched groove 46 which extends about the longitudinal axis X over an angle of 90°. On account of the groove 46 and the stop pin 44, one succeeds in the valve element 30 being able to rotate about the longitudinal axis X between two switching positions by an angle of 90°.

The switching opening 48 is formed in the periphery annular wall 32. This is configured as a hole which at its outer periphery is completely enclosed by parts of the annular wall 32. In the first switching position, the switching opening 48 can be brought to overlap with an outlet opening 50 which is connected to the delivery connection 22, so that a flow connection is created from the interior of the valve element 30 through the switching opening 48, the outlet opening 50 to the delivery connection 22. In the second switching position of the valve element 30 which is rotated by 90°, the switching opening 48 is brought to overlap with an outlet opening 52 which is connected to the delivery connection 24. This means that the delivery connection 24 runs out at the outlet opening 52 into the inside of the pump casing 6. In this switching position, a flow connection is therefore given from the inside of the valve element 30 through the switching opening 48, the outlet opening 52 to the delivery connection 24. A switch-over valve, with which for example a switch-over function as is described by way of FIG. 3 can be realized is therefore realized.

Figure 3:
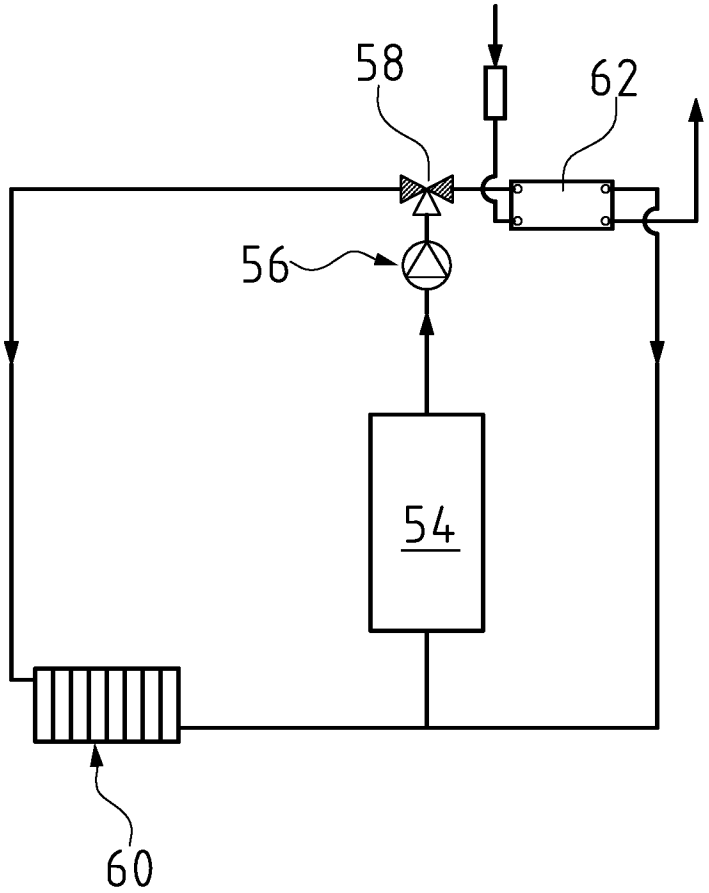
FIG. 3 is a circuit diagram of a heating facility with a centrifugal pump assembly according to FIGS. 1 and 2.

FIG. 3 schematically shows the circuit diagram of a heating facility. This heating facility comprises a primary heat exchanger 54, for example a gas heater. A centrifugal pump assembly 56 is arranged at the outlet side, which is to say downstream of primary heat exchanger 54, wherein this centrifugal pump assembly can be a centrifugal pump assembly as has been described previously and is described hereinafter. A valve element 58 which can be formed by the described valve element 30 can be formed at the outlet side, which is to say at the delivery side of the circulation pump assembly 56. The flow path can be switched between a heating circuit 60 for the temperature adjustment of a building and a secondary heat exchanger 62 for heating service water, via the valve device 58, in order to either supply the heating circuit 60 or the secondary heat exchanger 62 with heat transfer medium which is heated by the primary heat exchanger 54.

Figure 4:
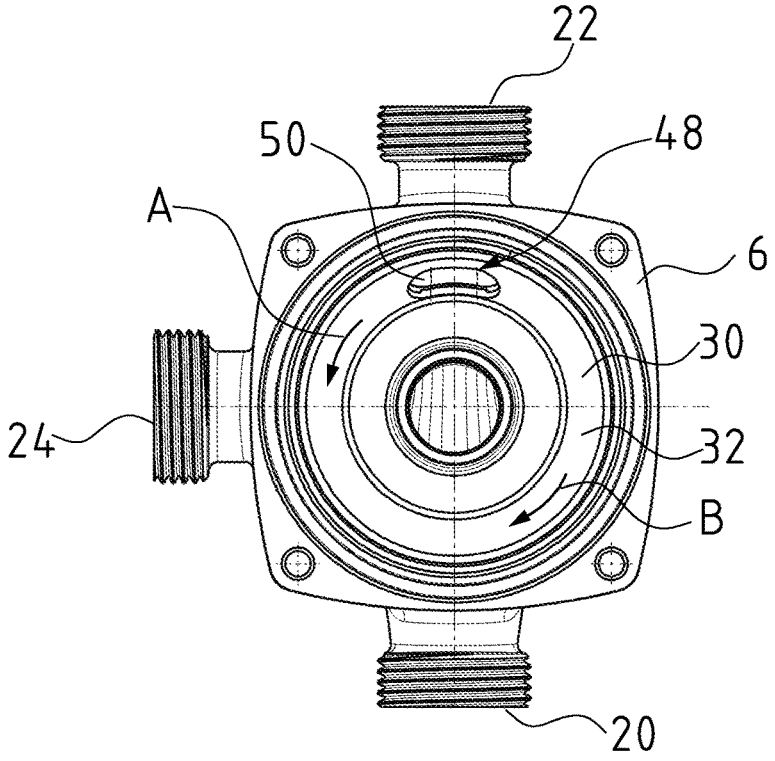
FIG. 4 is a plan view of the opened pump casing of a centrifugal pump assembly according to FIGS. 1 and 2 with a valve element in a first switching position.

The switching-over or moving of the valve element 30 is realized by control electronics 64 which are arranged in the electronics housing 8 and which activates the drive motor 2. For this, the control electronics 64 can in particular comprise a speed controller or frequency converter. One utilizes the fact that given a rapid start-up of the drive motor 2 and of the impeller 18, a pressure builds up in the peripheral region of the impeller more quickly than an annular flow which is capable of rotating the valve element 30. If for example the valve element is situated in the first switching position which is shown in FIG. 4 and in which the flow path through the delivery connection 22 is opened and the valve element 30 is to remain in this switching position on starting up the drive motor, then the dive motor 30 is rapidly accelerated so that a pressure builds up quickly in the inside of the valve element 30 and this element is pressed out of the released position which is shown in FIG. 7 into a bearing position, in which the outer side of the annular wall 32 and of the wall 34 come to frictionally bear on the inner surfaces of the pump casing 6, so that the valve element 30 is secured against rotation. The outer side of the valve element 30 therefore forms a releasable coupling with the inner side of the pump casing 6.

Figure 5:
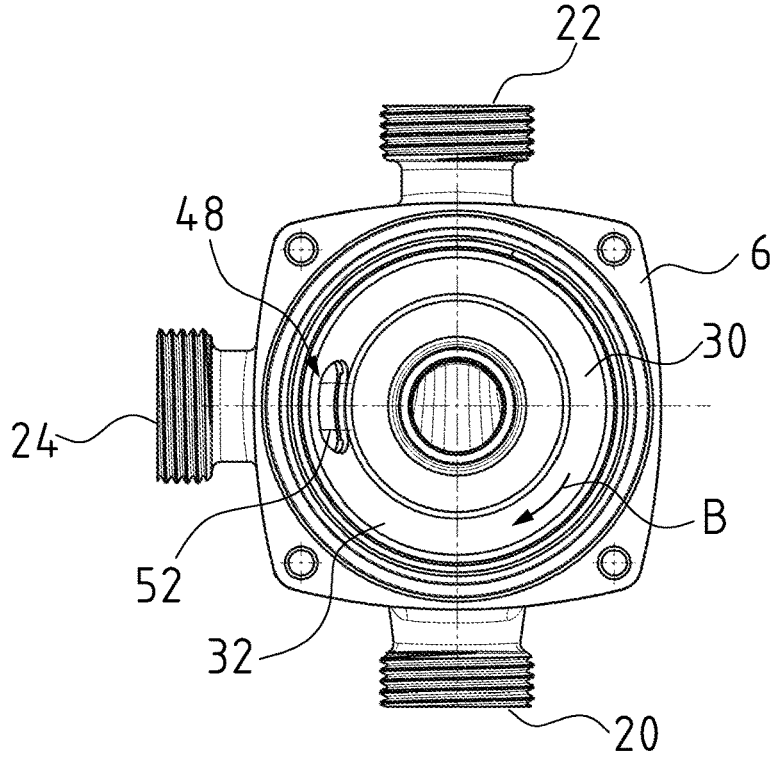
FIG. 5 is a view according to FIG. 4 with the valve element in a second switching position.
Figure 6:
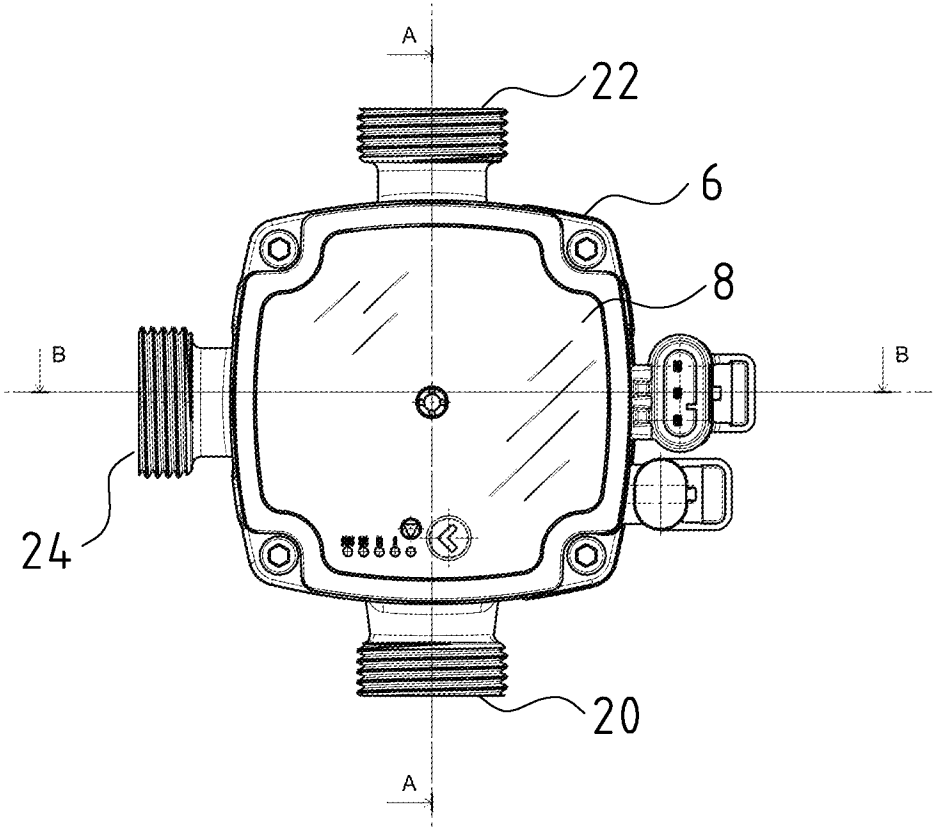
FIG. 6 is a face-side plan view upon a centrifugal pump assembly according to FIGS. 1 and 2.
Figure 8:
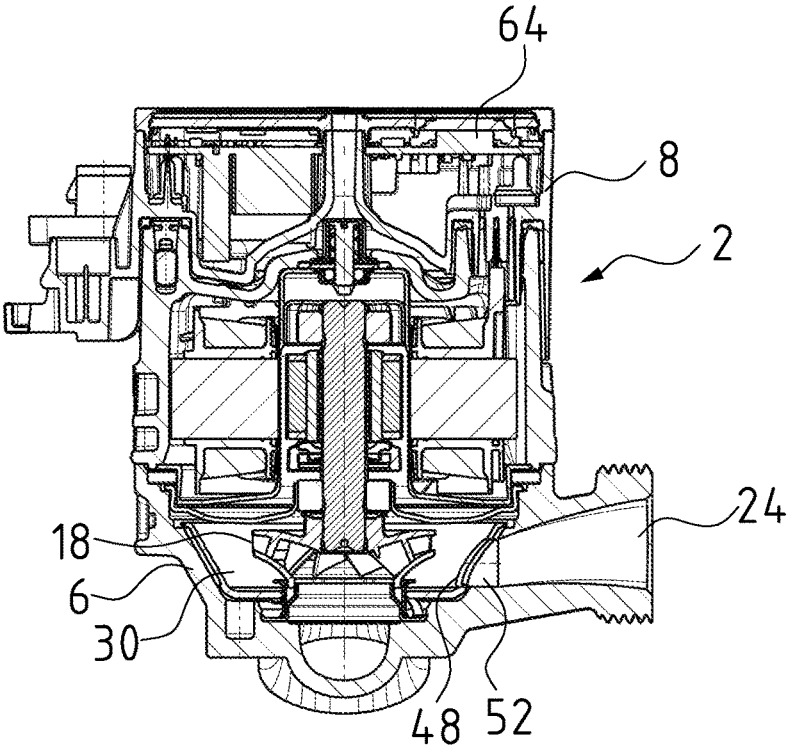
FIG. 8 is a sectioned view along line B-B in FIG. 6 with the valve element in a second switching position.

The impeller 18 is driven in the rotation direction A by the drive motor 2 at such a low speed that a pressure which can overcome the spring force which is produced by the spring ring 42 cannot build up in the inside of the valve element 30, in order to rotate the valve element 30 out of the first switching position which is shown in FIG. 4 into the second switching position which is shown in FIG. 5. The valve element 30 therefore remains in the released position which is shown in FIG. 7. However, after a certain time, an annular flow in the rotation direction A also builds up in the inside of the valve element 30 and this flow co-rotates the valve element 30 via frictional forces and therefore moves it into the second switching position which is shown in FIG. 5. If the speed of the drive motor 2 is subsequently increased again, then the valve element 30 in this switching position again gets into its bearing position in frictional contact with the inner surface of the pump casing 6. However, it is also possible to switch off the drive motor again in this switching position and to then bring it directly into operation in the opposite rotation direction B at such a high speed, that such a high pressure is again produced in a direct manner that the valve element 30 is moved in the axial direction X into the bearing position which is shown in FIG. 8 and cannot therefore be co-rotated in the rotation direction B by way of the flow. In order to rotate the valve element 30 into the first switching position again, the drive motor must be driven in the rotation direction B at such a speed that a flow for co-moving the valve element 30 cannot build up such a high pressure which is capable of overcoming the spring force of the spring ring 42.

Figure 9:
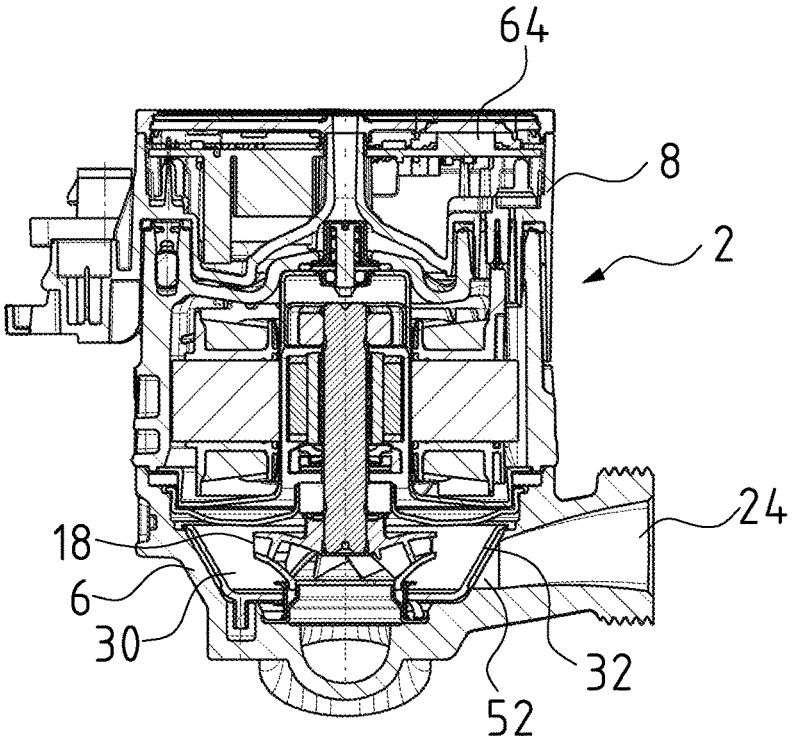
FIG. 9 is a sectioned view according to FIG. 8 with the valve element in a first switching position.
Figure 11:
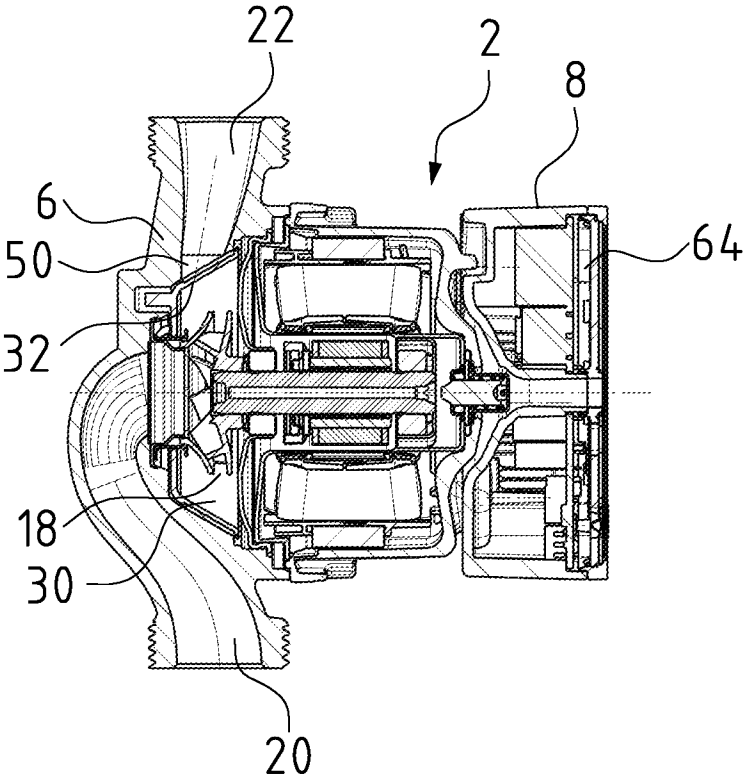
FIG. 11 is a sectioned view according to FIG. 10 with the valve element in a second switching position.
Figure 10:
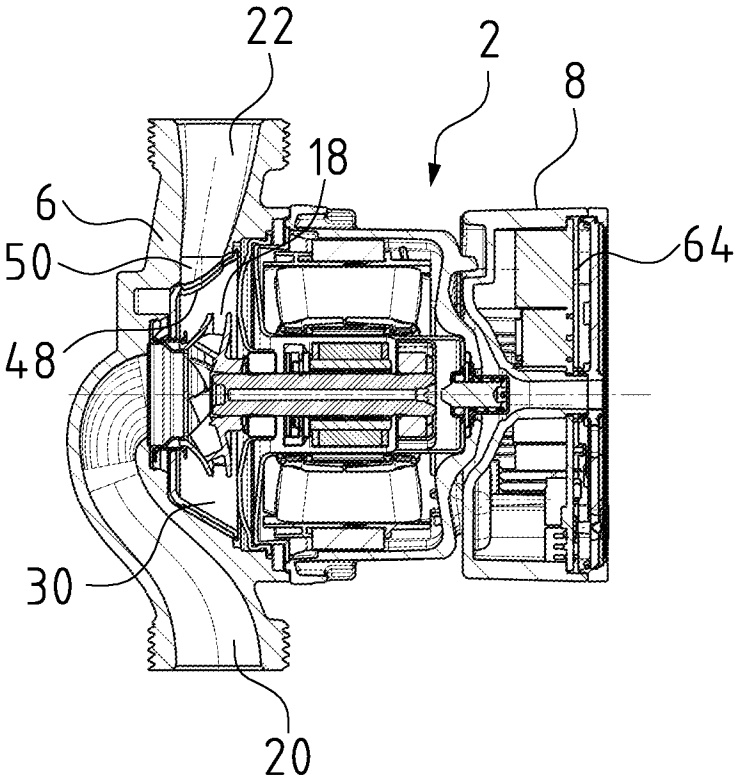
FIG. 10 is a sectioned view along the line A-A in FIG. 6 with the valve element in a first switching position.

FIG. 10 shows the first switching position with the valve element 30 in the bearing position. The switching opening 48 lies opposite the outlet opening 50. FIG. 11 shows the second switching position, in which a part of the annular wall 32 lies opposite the outlet opening 50, so that this is closed. Conversely, in the second switching position, as is shown in FIG. 8, the switching opening 48 lies opposite the outlet opening 52, whereas in the first switching position, as is shown in FIG. 9, a part of the annular wall 32 lies opposite the outlet opening 52 and therefore closed this. In FIGS. 8 to 11, the valve element 30 lies in its bearing position in each case, so that it bears on the inner wall of the pump casing 6 in the peripheral region of the outlet openings 50, 52 and can sealingly close these inasmuch as the annular wall 32 covers the outlet opening 50, 52.

Figure 13:
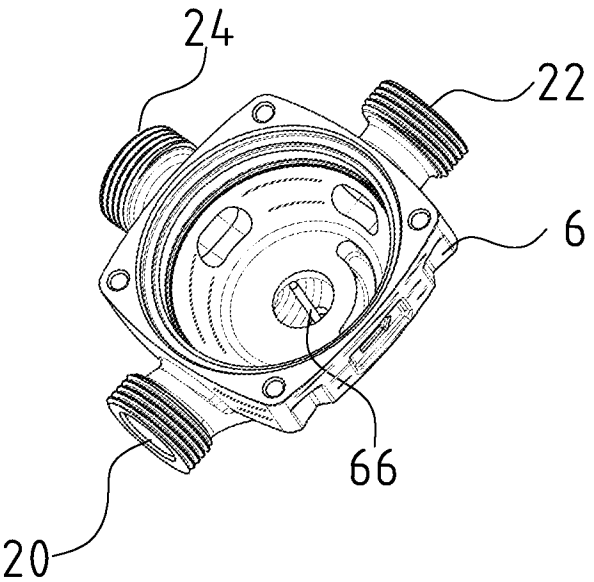
FIG. 13 is a perspective view into the opened pump casing of a centrifugal pump assembly according to FIG. 12.
Figure 12:
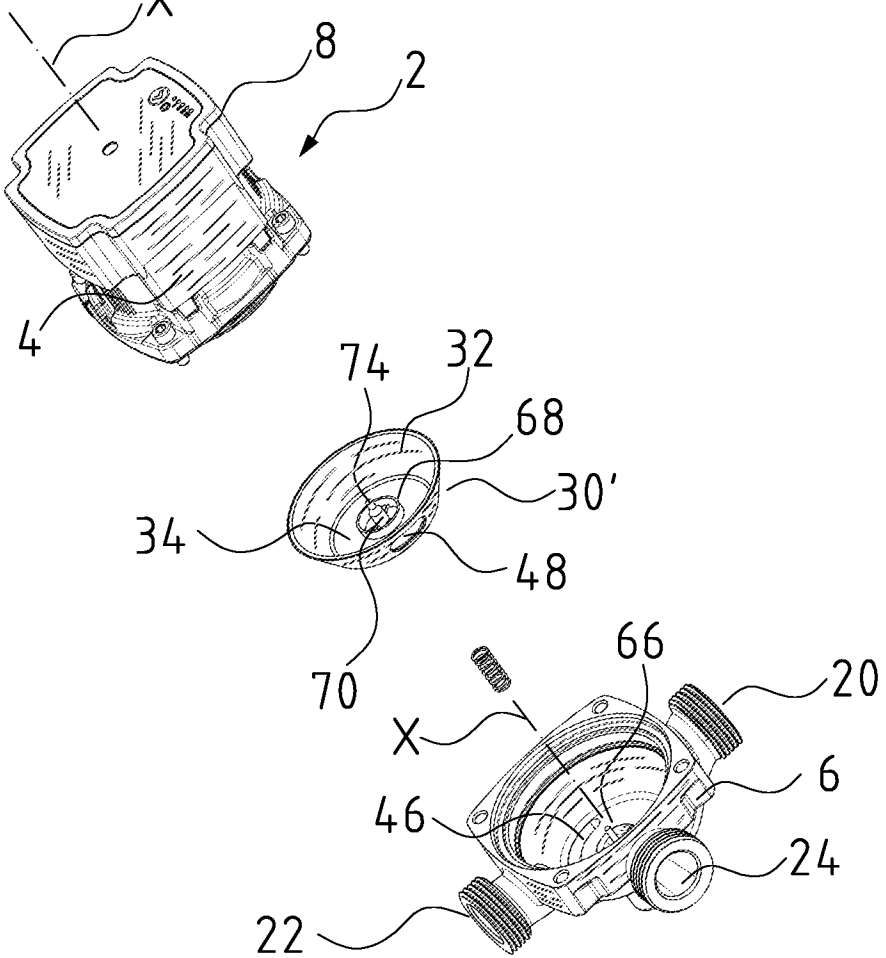
FIG. 12 is a perspective exploded view of a centrifugal pump assembly according to a second embodiment of the invention.
Figure 14:
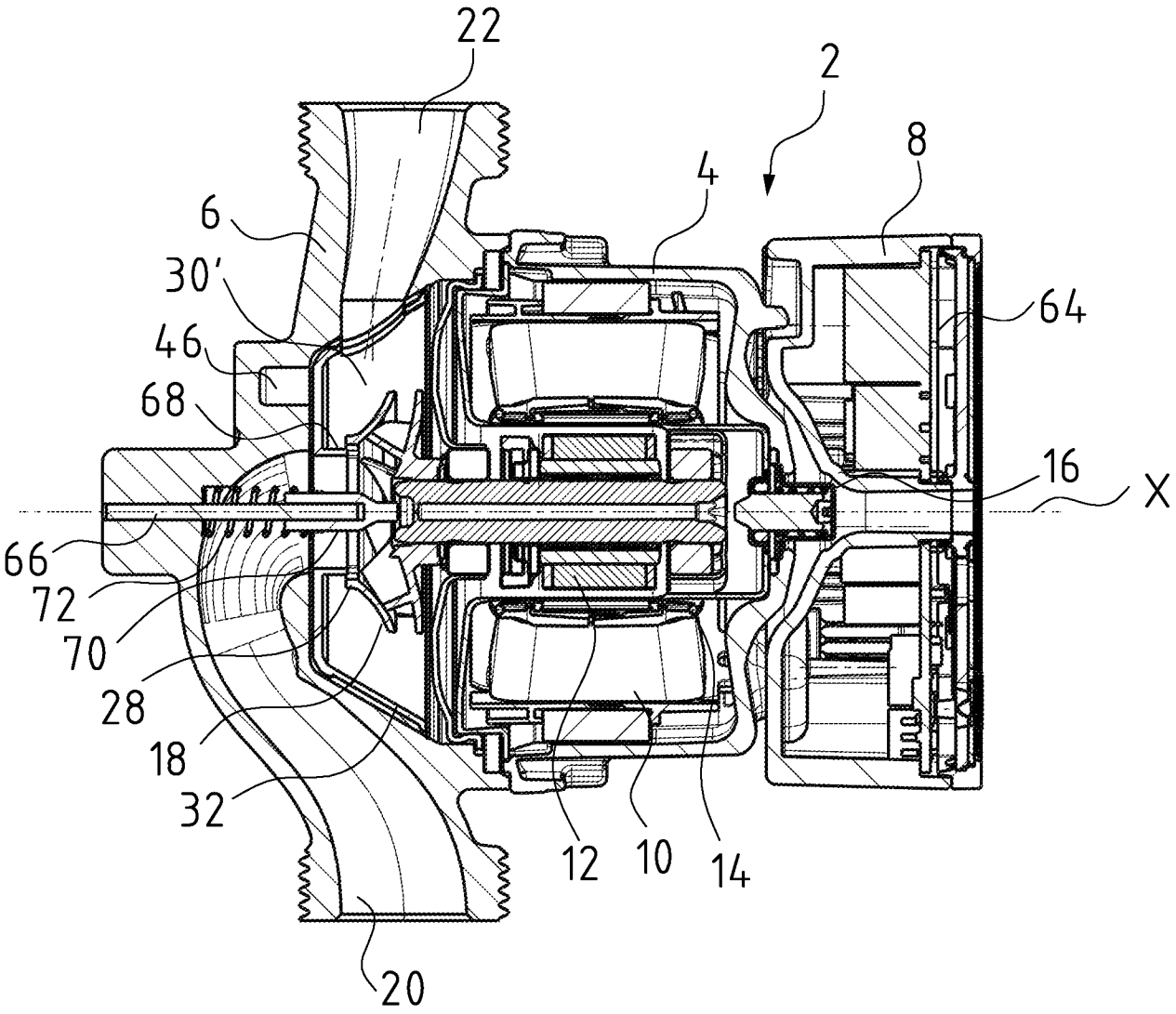
FIG. 14 is a sectioned view of a centrifugal pump assembly according to FIG. 12.

FIGS. 12 to 14 show a second embodiment example of a centrifugal pump assembly according to the invention, concerning which the valve element merely differs from the previously described valve element 30 with regard to the manner of its mounting. It is only the differences to the first embodiment example which are described hereinafter. Otherwise the preceding description is referred to. Concerning this second embodiment example, the valve element 30' is rotatably mounted on a bearing pin or bearing bolt 66. The bearing bolt 66 extends in the axial direction of the longitudinal axis X from the base into the inside of the pump casing 6. The valve element 30 on its wall 34 comprises an integrally formed suction stub 68 which instead of the inlet stub 26 is engaged with the suction port 28 of the impeller 18. A suction opening, in which a bearing sleeve 70 is held via connection webs, is located in the inside of the suction stub 68, wherein the bearing sleeve 70 is configured as one piece with the remaining part of the valve element 30'. The bearing sleeve 70 is placed on the bearing bolt 66 which is to say rotates on the bearing bolt 66. Furthermore, a spring 72 in the form of a compression spring is arranged in a manner surrounding the bearing bolt 66. The spring 72 assumes the function of the spring ring 42 according to the first embodiment example and generates a pressing force between the base of the pump casing 6 and the valve element 30', so that this in the released position which is shown in FIG. 14 can be pressed away from the inner wall of the pump casing 6 and can freely rotate. In this position, the bearing sleeve 70 with its closed axial end 74 which is away from the pump casing 6 is supported on the axial end of the rotor shaft 16. The manner of functioning of the valve element 30' corresponds to the preceding description. No differences result with the exception of the different mounting.

Figure 15:
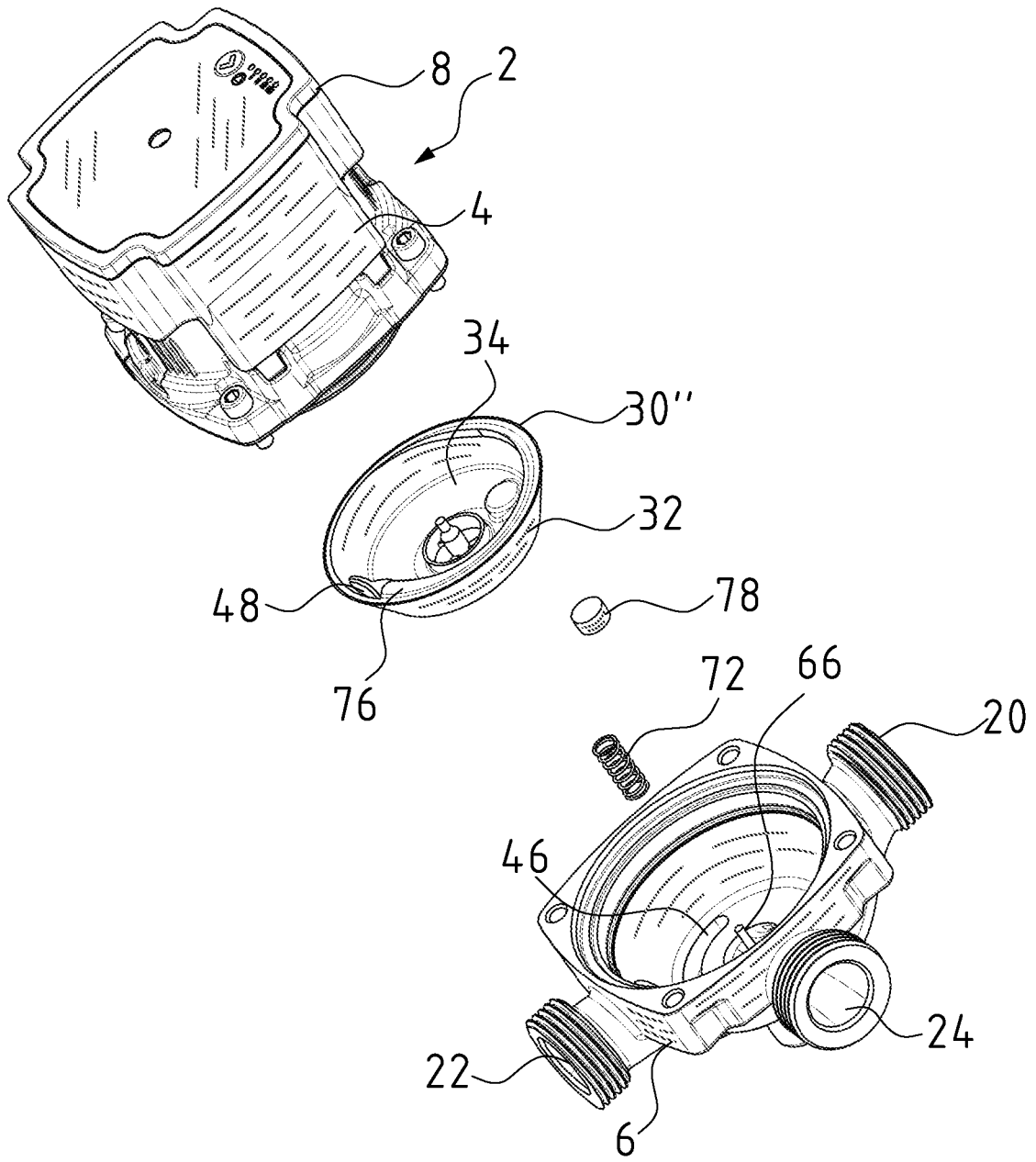
FIG. 15 is a perspective exploded view of a centrifugal pump assembly according to a third embodiment of the invention.
Figure 16:
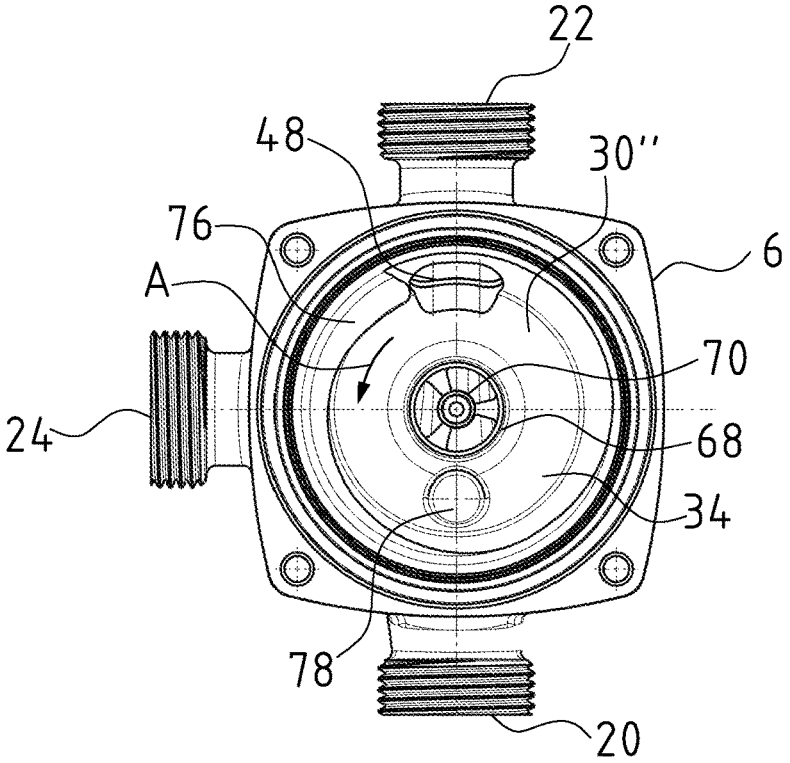
FIG. 16 is a view into the opened pump casing of the centrifugal pump assembly according to FIG. 15, with a valve element in a first switching position.
Figure 17:
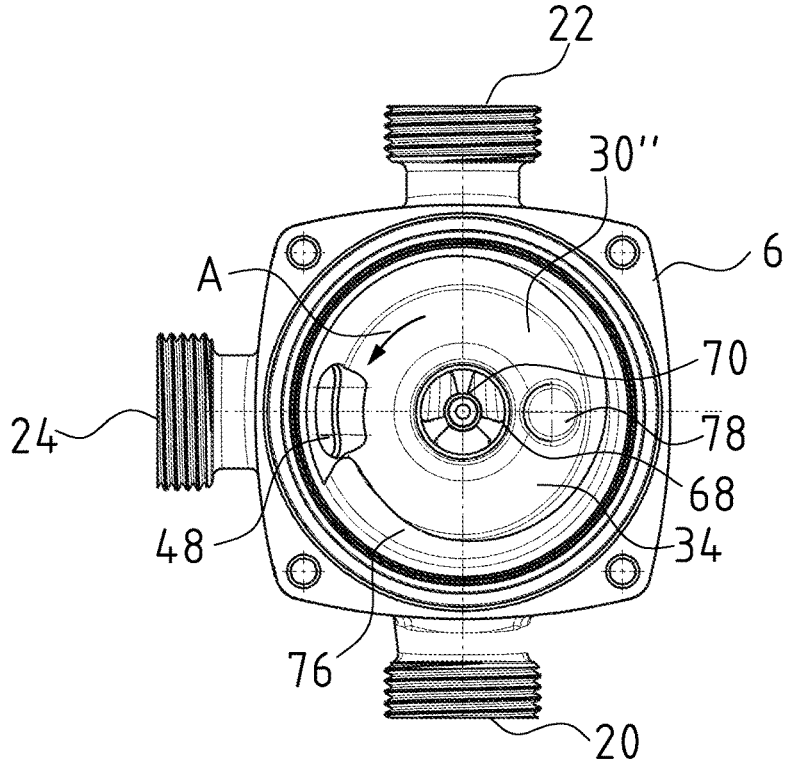
FIG. 17 is a view according to FIG. 16, with the valve element in a second switching position.

The third embodiment example according to FIGS. 15 to 17 corresponds essentially to the second embodiment example so that it is again only the differences which are described hereinafter. Otherwise the preceding description is referred to.

The valve element 30" in the inside comprise as spiral flow guide 76 which forms a spiral channel to the switching opening 48. The flow guide 76 is configured as a spiral projection which becomes narrower in the radial direction towards the switching opening 48, so that the free space between the flow guide 76 and the impeller 18 enlarges, so that a spirally widening flow channel to the outlet opening 48 is created. Herein, on operation, the flow runs in the rotation direction A in FIGS. 16 and 17. Since the flow guide 76 rotates together with the valve element 30" between the switching positions, an optimal flow guidance to each of the delivery connections 22 and 24 is always given on operation. It is to be understood that such a flow guide 76 could also be used with the first two embodiment examples.

Furthermore, the valve element 30" comprises a weight 78 which is arranged in a receiver in the base or the wall 34 of the valve element 30". The weight 78 lies diametrically opposite the switching opening 48 so that it lies at the bottom in the first switching position which is shown in FIG. 16. The weight 78 serves as a restoring element, so that the drive motor 2 merely needs to be driven in one rotation direction A. For restoring the valve element 30", it is not necessary to generate an annular flow in the opposite direction in the inside of the valve element 30". In contrast, the restoring is effected by way of gravity when the weight 78 moves downwards. If the pump assembly is to be brought into operation in the first switching position which is shown in FIG. 16, then the drive motor 2 is driven or accelerated by the control electronics 64 such that such a high pressure builds up in a direct manner that the spring force which is generated by the spring 72 can be overcome by a pressure force in the inside of the valve element 30". This means that the valve element 30" is pressed against the spring force of the spring 42 into bearing contact with the inner wall of the pump casing 6 by way of the generated fluid pressure so that it is frictionally fixed there and remains in the shown first switching position. In order to move the valve element 30" into the second switching position which is shown in FIG. 17, the drive motor 2 is brought into operation in an accordingly slower manner by the control electronics 64, so that an annular flow can firstly build up in the direction of the rotation direction A, said flow co-rotating the valve element 30" in the released position which is shown in FIG. 14. and therefore rotating it into the second switching position which is shown in FIG. 17. In this second switching position, the drive motor can be accelerated further, so that again such a fluid pressure builds up in the inside of the valve element 30" that the valve element 30' is pressed into the bearing position. On switching off the drive motor, the annular flow as well as the built-up pressure ceases, and the valve element 30" gets into its released position again due to the action of the spring 72. In this released position, the element can freely rotate again and the weight 78 produces a torque, so that the valve element 30" automatically rotates counter to the rotation direction A back into the first switching position which is shown in FIG. 16.

It is to be understood that such a restoring element can also be applied with the first two embodiment examples. Instead of a restoring element which acts by way of gravity, for example a spring or a magnetically acting restoring element could also be applied.

Instead of or additionally to an axial movement of the complete valve element 30, 30', 30" between the released and the bearing position, also only a movable section of the valve element 30, 30', 30" could be moved between a released and a bearing position. Thus for example the annular wall 32 can be configured in an elastic manner, in order to be deformed by a fluid pressure which prevails in the inside and to be brought to bear against an inner wall of the pump casing 6.

While specific embodiments of the invention have been shown and described in detail to illustrate the application of the principles of the invention, it will be understood that the invention may be embodied otherwise without departing from such principles.

The invention claimed is:

1. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein the annular wall in an extension direction transverse to a periphery thereof extends at an angle of smaller than 90° to the rotation axis.

2. A centrifugal pump assembly according to claim 1, wherein at least two outlet openings are connected to the delivery connections and with which the at least one switching opening can be brought to at least partly overlap depending on the switching position of the valve element and the at least two outlet openings are situated in a wall of the pump casing which faces the annular wall.

3. A centrifugal pump according to claim 1, wherein the valve element in the inside of the annular wall further comprises a wall which extends transversely to the rotation axis and which surrounds a suction port of the impeller.

4. A centrifugal pump assembly according to claim 1, wherein the annular wall comprises a circular outer contour.

5. A centrifugal pump assembly according to claim 1, wherein the valve element is rotatably mounted on a stationary component in the inside of the pump casing.

6. A centrifugal pump assembly according to claim 1, wherein an edge of the at least one switching opening is completely surrounded by at least one section of the annular wall.

7. A centrifugal pump assembly according to claim 1, wherein the valve element comprises at least one movable section which is movable between a bearing position, in which the at least one moveable section frictionally bears on a contact surface in the pump casing, and a released position, in which the at least one moveable section is movable relative to the contact surface on rotation of the valve element.

8. A centrifugal pump assembly according to claim 7, wherein the valve element is configured to provide a friction-fit contact of the at least one movable section in the bearing position, whereby the valve element is held in its switching position.

9. A centrifugal pump assembly according to claim 7, wherein the at least one movable section is configured as an elastic edge section of the annular wall.

10. A centrifugal pump assembly according to claim 7, wherein the valve element is completely movable in a direction transverse to its rotation direction, between a released position and a bearing position.

11. A centrifugal pump assembly according to claim 7, wherein the valve element and the pump casing are configured such that in the bearing position, at least a section of the valve element bears on an inner wall of the pump casing.

12. A centrifugal pump assembly according to claim 7, wherein the valve element is configured such that a pressure which prevails in a peripheral region of the impeller acts upon the valve element such that the at least one movable section or the complete valve element is moved into the bearing position.

13. A centrifugal pump assembly according to claim 12, further comprising a force generating means which subjects the valve element or the at least one movable section to force out of the bearing position in the direction of the released position.

14. A centrifugal pump assembly according to claim 1, wherein a flow guidance element leads to the at least one switching opening and is situated on the inner periphery of the annular wall.

15. A centrifugal pump assembly according to claim 1, wherein a central region of the valve element comprises a bearing sleeve which rotatably slides on a stationary bearing bolt in the pump casing.

16. A centrifugal pump assembly according to claim 1, wherein the valve element is rotatably mounted on an inlet stub which is arranged in the pump casing and is engaged with a suction port of the impeller.

17. A centrifugal pump assembly according to claim 1, wherein a restoring element acts upon the valve element in a valve element rotation direction and is configured such that the restoring element moves the valve element into a predefined initial position given a standstill of the impeller.

18. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein the valve element comprises at least one movable section which is movable between a bearing position, in which the at least one moveable section frictionally bears on a contact surface in the pump casing, and a released position, in which the at least one moveable section is movable relative to the contact surface on rotation of the valve element, the at least one movable section being configured as an elastic edge section of the annular wall.

19. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein the valve element comprises at least one movable section which is movable between a bearing position, in which the at least one moveable section frictionally bears on a contact surface in the pump casing, and a released position, in which the at least one moveable section is movable relative to the contact surface on rotation of the valve element, the valve element being completely movable in a direction transverse to its rotation direction, between a released position and a bearing position.

20. A centrifugal pump assembly comprising:

an electrical drive motor;

at least one impeller which is driven by the electrical drive motor;

a pump casing which surrounds the impeller and which comprises at least one suction connection and at least two delivery connections;

a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein the valve element comprises at least one movable section which is movable between a bearing position, in which the at least one moveable section frictionally bears on a contact surface in the pump casing, and a released position, in which the at least one moveable section is movable relative to the contact surface on rotation of the valve element, the valve element being configured such that a pressure which prevails in a peripheral region of the impeller acts upon the valve element such that the at least one movable section or the complete valve element is moved into the bearing position; and a force generating means which subjects the valve element or the at least one movable section to force out of the bearing position in the direction of the released position.

21. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein a flow guidance element leads to the at least one switching opening and is situated on the inner periphery of the annular wall.

22. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein a central region of the valve element comprises a bearing sleeve which rotatably slides on a stationary bearing bolt in the pump casing.

23. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein the valve element is rotatably mounted on an inlet stub which is arranged in the pump casing and is engaged with a suction port of the impeller.

24. A centrifugal pump assembly comprising:

an electrical drive motor;

at least one impeller which is driven by the electrical drive motor;

a pump casing which surrounds the impeller and which comprises at least one suction connection and at least two delivery connections; and a rotatable valve element arranged in the pump casing, said valve element being movable between at least two switching positions, in which flow paths through the at least two delivery connections are opened to a different extent, wherein the valve element comprises an annular wall which surrounds the impeller and in which at least one switching opening is formed and the valve element is rotatably mounted about a rotation axis which is centric to the annular wall, in the inside of the pump casing, wherein a restoring element acts upon the valve element in a valve element rotation direction and is configured such that the restoring element moves the valve element into a predefined initial position given a standstill of the impeller.

* * * * *